United States Patent [19]

Gustafsson

[11] 4,181,182

[45] Jan. 1, 1980

[54] WAGON HAVING INCORPORATED SUPPORT JACKS

[75] Inventor: Sven H. Gustafsson, Älvsjö, Sweden

[73] Assignee: Atlas Copco AB, Stockholm, Sweden

[21] Appl. No.: 800,563

[22] Filed: Jun. 21, 1977

[51] Int. Cl.[2] ..... E21C 11/02

[52] U.S. Cl. ..... 173/23; 180/9.5

[58] Field of Search ..... 173/23, 24, 39, 45; 180/9.5

[56] References Cited

U.S. PATENT DOCUMENTS

| | | | |
|---|---|---|---|
| 3,181,623 | 5/1965 | Lindgren | 173/22 |
| 3,189,103 | 6/1965 | Attebo et al. | 173/22 |
| 3,225,849 | 12/1965 | La Casse | 180/9.5 |
| 3,289,779 | 12/1966 | Feucht | 180/9.5 |
| 3,412,812 | 11/1968 | Kindsfater | 173/23 |
| 3,493,058 | 2/1970 | Zitko | 173/23 |
| 3,722,601 | 3/1973 | Klein et al. | 173/23 |

*Primary Examiner*—Robert A. Hafer

*Attorney, Agent, or Firm*—Jon M. Lewis

[57] ABSTRACT

A drill wagon has oscillatable crawler frames. Each crawler frame has a hydraulic ground engaging support jack at one end.

18 Claims, 4 Drawing Figures

35
45
30
29
34
31
32
33
46
26
10
16,17
28
18,19
12,13
11
22,23
36
24,25
14,15
41,42
39,40
37,38
43,44

WAGON HAVING INCORPORATED SUPPORT JACKS

This invention relates to a wagon of the kind that has a main frame carried by mutually oscillatable wheel frames or crawler frames and it relates particularly to crawler drill wagons that have a feed beam for a rock drill mounted on the distal end of a boom.

When such a crawler drill wagon is used the feed beam is used as a support to make a three point support. If the direction of the feed beam need to be adjusted during drilling, the entire rig tends to move since the feed beam forms one of the three supports. The adjustment will therefore be difficult and will take time.

When using a drill wagon according to the invention, it will be easier for the operator to position the wagon and the feed beam and the wagon will stand more stable.

DETAILED DESCRIPTION OF PREFERRED EMBODIMENTS

Figure 1:
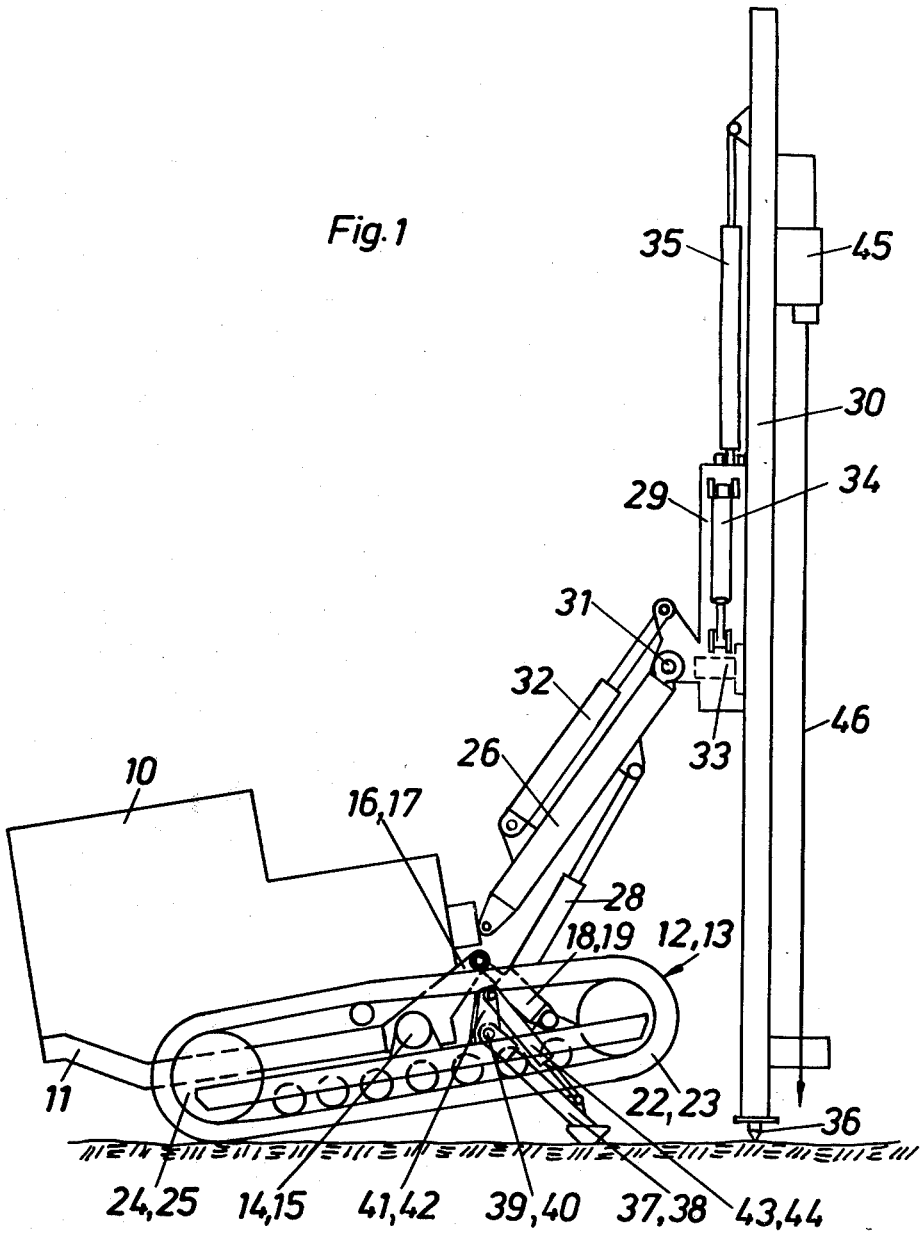
FIG. 1 is a side view of a drill wagon.
Figure 2:
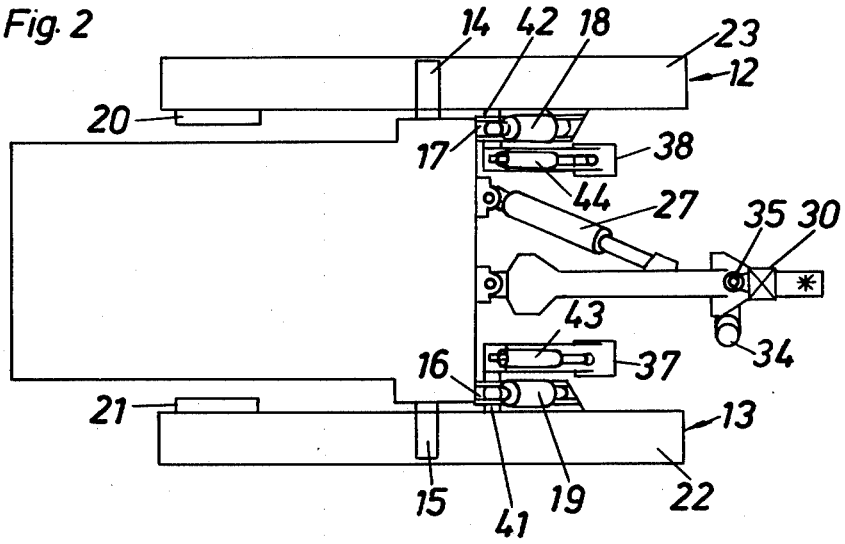
FIG. 2 is a top plan view of the drill wagon shown in FIG. 1.

The drill wagon according to FIGS. 1–2 comprises a main frame 11 that carries a body 10. Two crawler frames 12, 13 are journal-mounted on two coaxial trunnions 14, 15 on the main frame. The crawler frames are also coupled to brackets 16, 17 on the main frame by means of two hydraulic cylinders 18, 19 that are pivotably mounted to a respective crawler frame and to the main frame. These two hydraulic cylinders 18, 19 are hydraulically connected together so that one of them extends when the other contracts. Therefore the main frame will always take up a middle position between the swing positions of the crawler frames. Each crawler frame carries an individually operable motor and gearing unit 20, 21 that drives the crawler treads 22, 23 through drive wheels 24, 25. Each motor and gearing unit includes a friction brake or a locking device to lock the respective drive wheel. A boom 26 is pivotably mounted on the main frame to pivot about two perpendicular axes in order to be laterally swingable by means of a hydraulic cylinder 27 and vertically swingable by means of a hydraulic cylinder 28. On the outer free end of the boom 26, a holder 29 for feed beam 30 is pivotably mounted to be swingable vertically about a trunnion 31 by means of a hydraulic cylinder 32 and to be swingable about a trunnion 33 that is perpendicular to the trunnion 31 by means of a hydraulic cylinder 34. The feed beam 30 is axially displaceable in its holder 29 by means of a hydraulic cylinder 35 and it has a spur 36. A percussive rock drill 45 is slidably mounted on the feed beam 30. A drill rod is designated by 46.

A pair of support legs 37, 38 are pivotably mounted about pivots 39, 40 on the brackets 41, 42 on the crawler frames. The support legs 37, 38 are swingable by means of hydraulic cylinders 43, 44 which are pivotably coupled between the brackets and the support legs so that the support legs 37, 38 and the cylinders 43, 44 form together hydraulic support jacks.

In FIG. 1, the drill wagon is shown in drilling position. The crawler frames are supported on the one hand by the support legs 37, 38 and on the other hand on the crawler treads at the ends of the treads that mesh with the lockable drive wheels 24, 25. This four point support is very stable since the crawler treads are effectively locked at their contact area to the ground and since there will be a statically determined four-point-system due to the crawler frames being swingable about the trunnions 14, 15. The swingability of the crawler frames permits a stable support in rough terrain. By means of the cylinder 35 the feed beam can be advanced against the rock until its spur 36 will take up a suitable force against the rock and reduce the force that is taken up by the support legs without unloading the legs completely. Then, if the spur 36 of the feed beam is retracted off the ground, the wagon will still stand stable.

Figure 4:
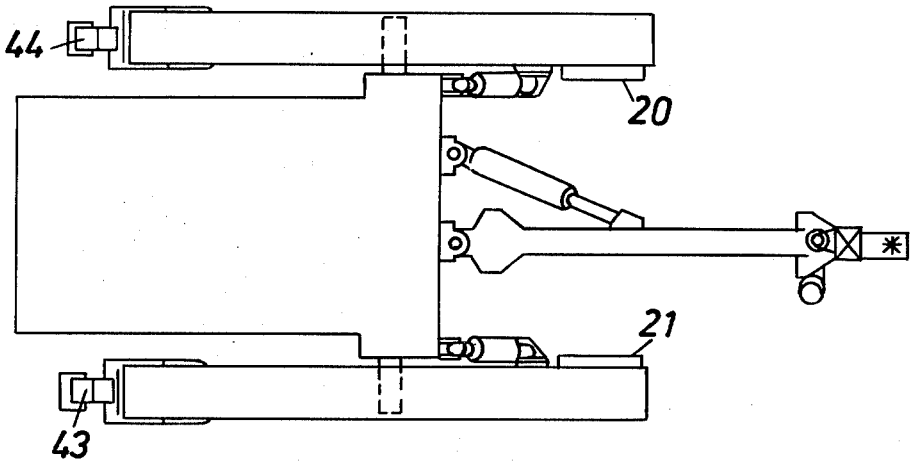
FIG. 4 is a top plan view of the drill wagon shown in FIG. 3.
Figure 3:
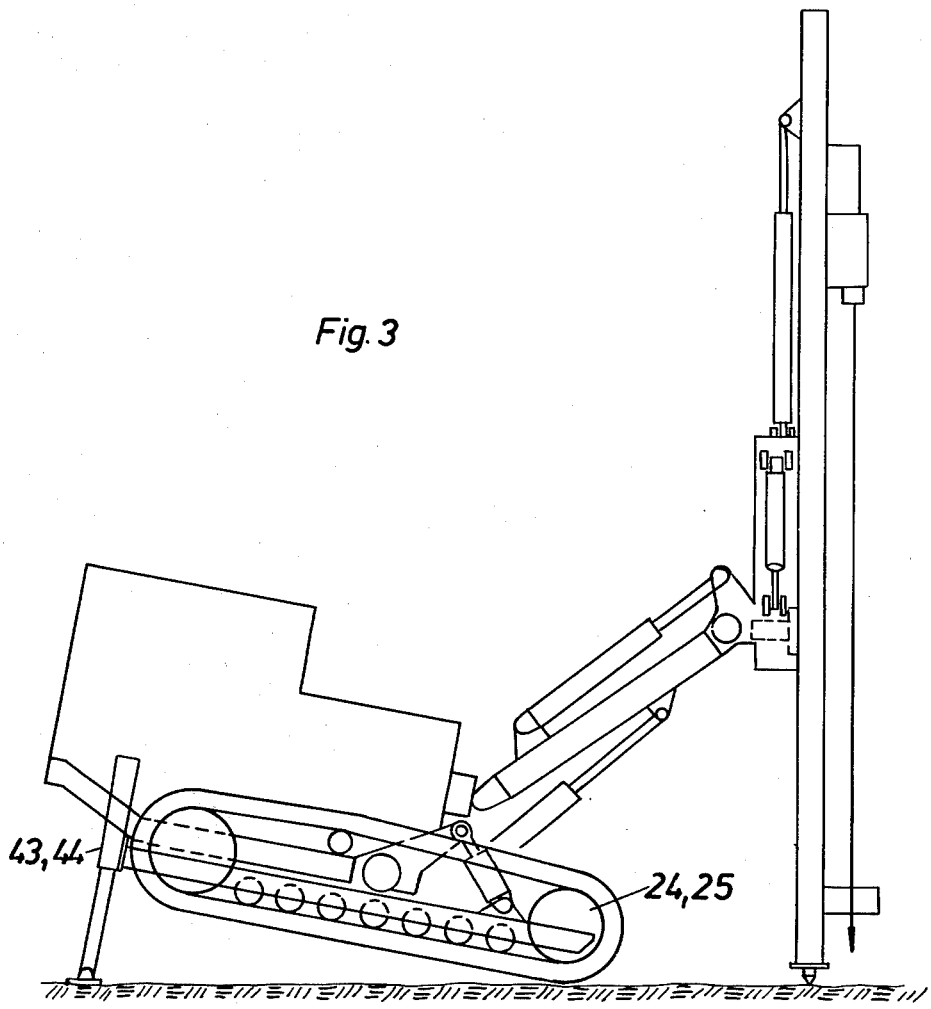
FIG. 3 is a side view of a modified drill wagon.

In FIGS. 3 and 4 an alternative embodiment is shown in which the support jacks 43, 44 are not mounted in the same end of the wagon as the feed beam. In this embodiment, the support jacks 43, 44 are mounted on extensions of the crawler frames so that they are located behind the crawler tracks. This permits a higher force on the spur 36 than should be the case if the support jacks would be located nearer the trunnions 15 about which the crawler frames oscillate. A drill wagon can alternatively also be provided with four support jacks, that is, the crawler frames can have two jacks each; one at each end.

What I claim is:

1. A wagon having a main frame for carrying a drilling assembly, said wagon being supported by oscillable first and second endless crawler frames disposed one on each side of said main frame;

said first and said second frames each having at least a front rotary member and a rear rotary member for the propulsion of said wagon by means of said rotary members driving said endless crawler frames;

connecting means for oscillably connecting said first and said second endless crawler frames such as to permit self adjustment of the first and second crawler frames with respect to said main frame in a manner such that said crawler frames substantially follow contours of terrain when said drill wagon is in motion over said terrain;

motor means for the propulsion of said wagon over terrain;

a first power actuated support jack mounted on and at one end of said first crawler frame; a second power actuated support jack mounted on and at one end of said second crawler frame, said first and second support jacks being free from said main frame and being actuable and adapted to act upon said first and second crawler frames to take support against the terrain adjacent said crawler frames for raising one end of said first and said second crawler frames above said terrain;

said first and second jacks being supported from and disposed on said first and second frames and adapted to form a stable four-point support arrangement comprising said first and said second jacks and the other ends of said first and said second crawler frames, remaining on said terrain for supporting said wagon stably.

2. The wagon according to claim 1 wherein said drilling assembly includes a drill means mounted thereon.

3. The wagon according to claim 2 wherein said drill means includes a feed beam being adapted to be disposed to take support against said terrain with a determinable force.

4. The wagon according to claim 3 wherein said connecting means comprise trunnions.

5. The wagon according to claim 3 wherein said drill means includes a laterally and vertically swingable boom, said boom having a distal end with said feed beam swingably disposed thereon.

6. The wagon according to claim 4 wherein said drill means includes a laterally and vertically swingable boom, said boom having a distal end with said feed beam swingably disposed thereon.

7. The wagon according to claim 1 including locking means associated with said motor means for locking said motor means.

8. The wagon according to claim 7 wherein said jacks comprise hydraulically powered jacks.

9. The wagon according to claim 7 wherein said motor means comprise drive wheels.

10. A drill wagon having a main frame for carrying a drilling assembly and being supported by mutually oscillable first and second independently movable endless crawler frames disposed one on each side of said main frame;

oscillable connecting means for connecting said first and said second crawler frames to said main frame such that said crawler frames substantially follow gross contours of said terrain when said drill wagon is in motion over said terrain;

motor means for powering said crawler frames and thereby for propelling said wagon over terrain, said motor means together with said first and said second crawler frames being adapted to move with respect to said main frame and swingable about said connecting means;

a first power actuated support jack mounted on one end of said first crawler frame, said first and second jacks being actuable to act upon said first and second crawler frames and to take support against terrain adjacent said crawler frames for raising at least said one end of each of said first and second crawler frames from said terrain;

drill means disposed on said main frame, said drill means having a feed beam with one end being mounted and adapted to be disposed against terrain, said first and said second jacks being disposed on said first and said second crawler frames and adapted in a relationship when extended with said crawler frames to form a four-point support arrangement; and a fifth support point comprising said one end of said feed beam disposed against said terrain whereby a five-point suspension system is provided for stably supporting said drill wagon.

11. The wagon according to claim 10 wherein said drill means includes a laterally and vertically swingable boom, said boom having a distal end having said feed beam swingably disposed thereon.

12. The wagon according to claim 11 including locking means associated with said motor means for locking said motor means.

13. The wagon according to claim 12 wherein said jacks comprise hydraulically powered jacks.

14. The wagon according to claim 10 wherein said connecting means include means for maintaining said main frame in an angular position intermediate to said first and said second crawler frames.

15. The wagon according to claim 14 wherein said crawler frames include endless looplike tracks.

16. The wagon according to claim 14 wherein said crawler frames comprise wheels.

17. The wagon according to claim 15 wherein said crawlers are driven by said motor means comprising motors mounted on opposite ends of said first and said second crawler frames.

18. A wagon having a main frame for carrying a drilling assembly, first and second crawler frames for supporting the wagon;

said first and said second crawler frames having motive means with at least a front rotary member and a rear rotary member for the propulsion of said wagon;

connecting means for oscillating said first and said second crawler frames with respect to said main frame such that said first and said second crawler frames are adapted to move swingably about horizontal axes with respect to said main frame so as to substantially follow contours of terrain when said drill wagon is in motion over said terrain;

motor means for powering said motive means for the propulsion of said wagon over terrain; and a first power actuated support jack mounted on a first end of said first crawler frame; a second power actuated support jack mounted on a first end of said second crawler frame, means to lock said rotary members against rotation of said rotary members at the second ends of said first and second crawler frames respectively, said first and second jacks being actuable and adapted to act upon said first and second crawler frames to take support against the terrain adjacent said motive means for raising said first ends of said first and said second frames above said terrain.

* * * * *